US009366465B2

(12) United States Patent
McMasters et al.

(10) Patent No.: US 9,366,465 B2
(45) Date of Patent: Jun. 14, 2016

(54) SYSTEM AND METHOD FOR IMPROVING CHARGE ACCURACY BY TEMPERATURE COMPENSATION

(75) Inventors: Mark McMasters, Owatonna, MN (US); William Brown, Owatonna, MN (US); Gary Murray, Montpelier, OH (US)

(73) Assignee: BOSCH AUTOMOTIVE SERVICE SOLUTIONS INC., Warren, MI (US)

( * ) Notice: Subject to any disclaimer, the term of this patent is extended or adjusted under 35 U.S.C. 154(b) by 1071 days.

(21) Appl. No.: 13/178,960

(22) Filed: Jul. 8, 2011

(65) Prior Publication Data

US 2013/0008192 A1 Jan. 10, 2013

(51) Int. Cl.
*F25B 45/00* (2006.01)

(52) U.S. Cl.
CPC ..... *F25B 45/00* (2013.01); *F25B 2700/21* (2013.01)

(58) Field of Classification Search
CPC ..... F25B 45/00; F25B 2700/21
USPC ..... 62/77, 149, 292
See application file for complete search history.

(56) References Cited

U.S. PATENT DOCUMENTS 4,114,448 A * 9/1978 Merritt ..... 62/129
4,624,112 A * 11/1986 Proctor ..... B60H 1/00585 62/149
4,982,576 A * 1/1991 Proctor ..... B60H 1/00585 62/195
2004/0083744 A1* 5/2004 Harte ..... 62/130
2005/0247070 A1* 11/2005 Arshansky ..... F25B 45/00 62/77
2005/0262855 A1 12/2005 Hsieh et al.
2006/0101835 A1* 5/2006 Meldahl ..... B60H 1/00585 62/149
2006/0137366 A1* 6/2006 Kang et al. ..... 62/149
2009/0055044 A1* 2/2009 Dienst ..... 701/32
2009/0126375 A1* 5/2009 Toyoshima ..... F25B 45/00 62/77
2009/0158756 A1* 6/2009 Brown ..... B60H 1/00585 62/77
2009/0188263 A1* 7/2009 Murray ..... B60H 1/00585 62/77
2011/0036104 A1* 2/2011 Toyoshima ..... F25B 45/00 62/77

FOREIGN PATENT DOCUMENTS

JP 2005114184 A * 4/2005

OTHER PUBLICATIONS

International Search Report & Written Opinion for PCT/US2012/045653, mailed Oct. 16, 2012.

* cited by examiner

*Primary Examiner* — Emmanuel Duke
(74) *Attorney, Agent, or Firm* — Baker Hostetler LLP

(57) ABSTRACT

A method and charging apparatus for adding refrigerant to an air conditioning system are provided. The method includes calculating a temperature differential by measuring a first temperature of a refrigerant inside of a refrigerant container and measuring a second temperature either at the air conditioning system or the ambient temperature. The method further includes using the temperature differential to calculate a compensation amount of refrigerant to add to a previously determined recommended amount of refrigerant based on the type of air conditioning system being charged.

14 Claims, 5 Drawing Sheets

SYSTEM AND METHOD FOR IMPROVING CHARGE ACCURACY BY TEMPERATURE COMPENSATION

FIELD OF THE INVENTION

The present invention relates generally to a system and method for charging and/or recharging air conditioning systems. In particular, the present invention relates to improving charge accuracy of refrigerant by using temperature compensation.

BACKGROUND OF THE INVENTION

Air conditioning systems are commonplace in homes, office buildings and a variety of vehicles including, for example, automobiles. Over time, the refrigerant utilized in these systems gets depleted and/or contaminated. As such, in order to maintain the overall efficiency and efficacy of an air conditioning system, the refrigerant utilized therein may be periodically replaced or recharged.

Currently available processes for recharging air conditioning systems typically include connecting the recharging unit to an air conditioning (A/C) system and transferring the refrigerant from a refrigerant tank of the recharging unit to the A/C system. The transferred amount includes a target amount of refrigerant based on the type of A/C system being charged. However, some refrigerant may be left in the hoses or fittings. Thus, there needs to be a process that ensure that proper amounts of refrigerant are being charged into the A/C systems.

SUMMARY OF THE INVENTION

At least in view of the above, it would be desirable to provide novel methods of charging and/or recharging air conditioning systems with greater speed and/or accuracy. It would also be desirable to provide novel devices and/or systems capable of implementing such methods and of thereby providing such benefits.

The foregoing needs are met, to a great extent, by one or more embodiments of the present invention. According to one such embodiment, a method of adding refrigerant to an air conditioning system, the method includes obtaining a recommended amount of refrigerant for the air conditioning system, measuring a first refrigerant temperature with a first sensor, measuring a second temperature with a second sensor, determining a compensated amount of refrigerant to be added to the air conditioning system based upon a temperature differential between the first refrigerant temperature and the second temperature, and charging the air conditioning system with the compensated amount of refrigerant and the recommended amount of refrigerant.

In accordance with another embodiment of the present invention, a refrigerant charging apparatus includes a refrigerant container configured to store a refrigerant, hose connectors configured to facilitate transfer of the refrigerant from the refrigerant container to an air conditioning system, a first temperature sensor configured to determine a first temperature within the refrigerant container, a second temperature sensor configured to determine a second temperature within the charging apparatus, and a controller configured calculate a first temperature differential between the first and second temperatures, and using the temperature differential to calculate a compensated amount of refrigerant to add to a recommended amount of refrigerant to charge the air conditioning system.

In accordance with yet another embodiment of the present invention, A refrigerant charging apparatus that includes means for containing refrigerant to charge an air conditioning system, means for transferring refrigerant from the means for containing to the air conditioning system, a first means for sensing a first temperature within the means for containing, a second means for sensing a second temperature within the charging apparatus, and a means for controlling configured calculate a first temperature differential between the first and second temperatures, and using the first temperature differential to calculate a compensated amount of refrigerant to add to a predetermined amount of refrigerant to charge the air conditioning system.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
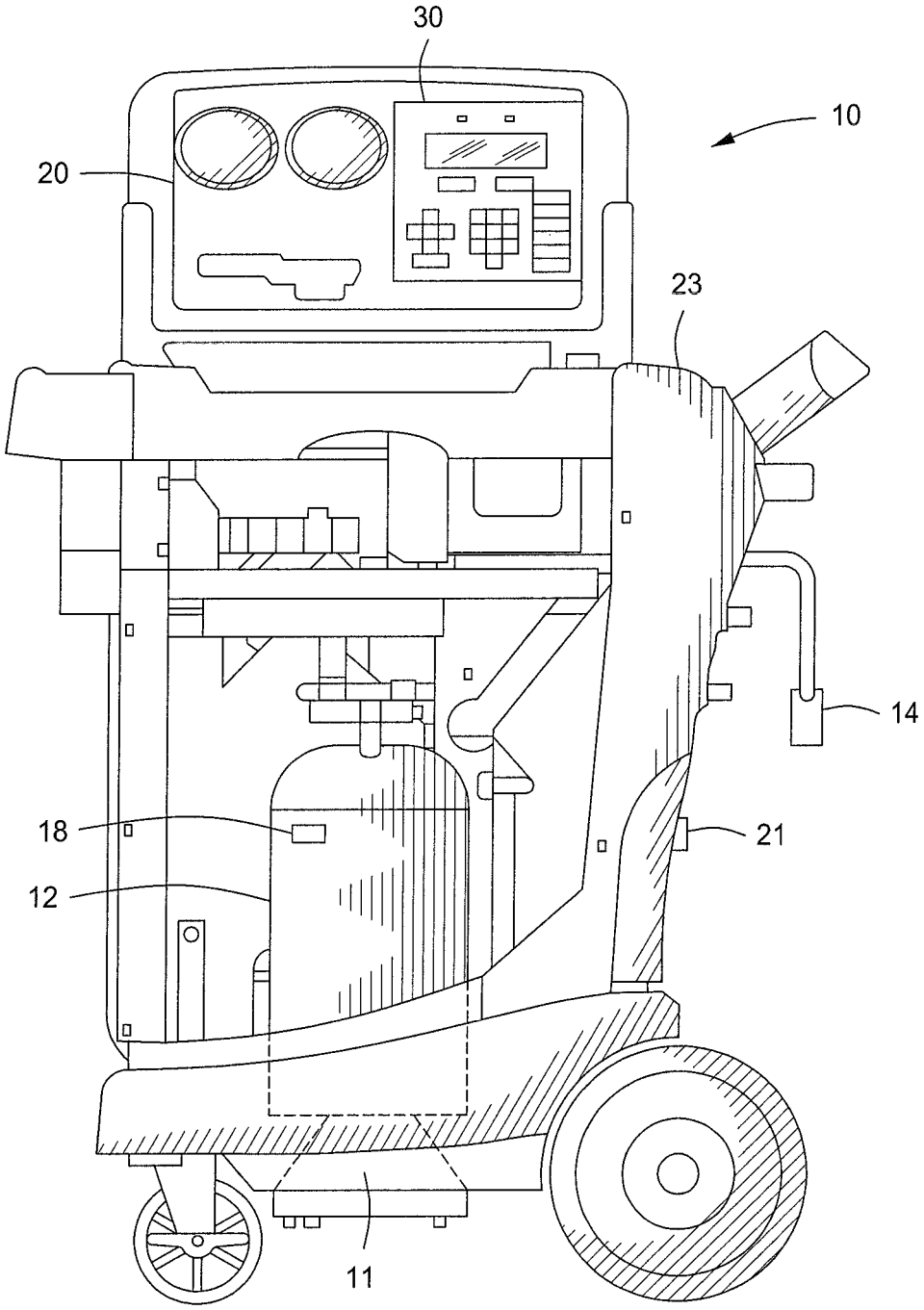
FIG. 1 is an illustration of an air conditioning recharging system according to one embodiment of the present invention.

The invention will now be described with reference to the drawing figures, in which like reference numerals refer to like parts throughout. FIG. 1 is an illustration of an apparatus configured to add refrigerant to an A/C system (i.e., an air conditioning charging and/or recharging system 10) according to one embodiment of the present invention. As illustrated in FIG. 1, the recharging system 10 includes a refrigerant container 12 that is configured to store the refrigerant. No limitations are placed on the kind of refrigerant that may be used according to the present invention. As such, any refrigerant that is commonly available (e.g., R-134a, $CO_2$, R1234yf, etc.) may be stored within the refrigerant container 12. However, according to certain embodiments of the present invention, the refrigerant container 12 is particularly configured to accommodate refrigerants that are commonly used in the A/C systems of vehicles (e.g., cars, trucks, boats, planes, etc.).

Figure 2:
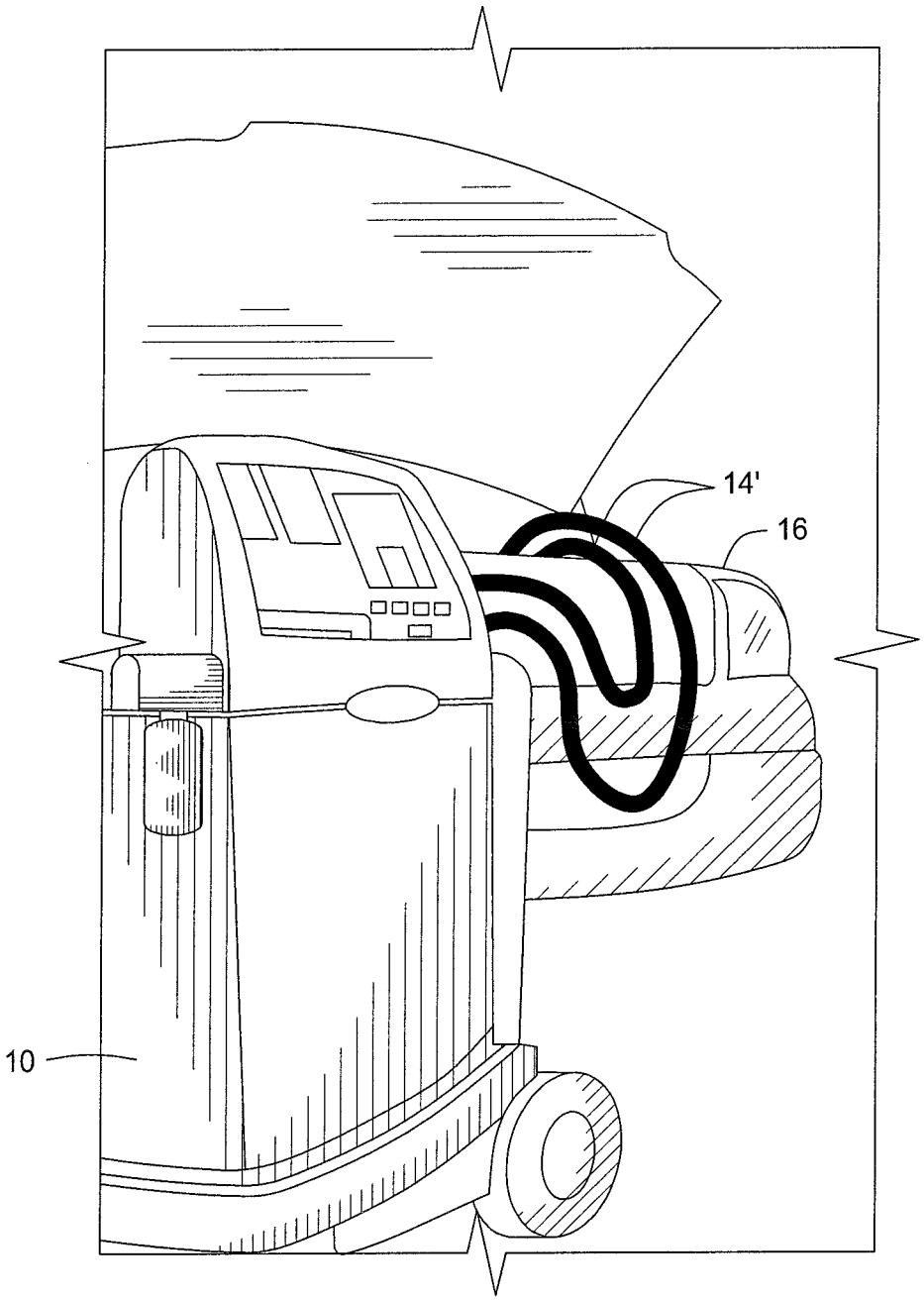
FIG. 2 is an illustration of the air conditioning recharging system illustrated in FIG. 1 as connected to a vehicle.

The above-discussed charging/recharging system 10 also includes hose connections 14 that is configured to facilitate transfer of the refrigerant from the refrigerant container 12 to the A/C system as shown in FIG. 2. FIG. 2 is an illustration of the air conditioning recharging system 10 illustrated in FIG. 1 as it is connected to a vehicle 16 and, more specifically, as it is connected to an automobile. As illustrated in FIG. 2, the hose connections 14 may include and/or be extended by one or more hoses 14'. According to certain embodiments of the present invention, each of these hoses 14' is connected to (i.e., engaged with) the recharging system 10 on one end thereof and to an inlet or/and outlet port of the A/C system of the vehicle 16 on the other end thereof.

Returning to FIG. 1, the recharging system 10 also includes temperature sensor 18 that is configured to determine and/or sense a temperature within the refrigerant container 12. The temperature sensor 18 may be placed on the outside of the refrigerant container 12 or inside of the refrigerant container 12. Further, depending on the type of temperature sensor 18 used or as desired by the user, the temperature sensor may be placed on an upper, middle or lower portion of the refrigerant container 12. In another embodiment, the temperature sensor 18 may be placed at or near the point where the refrigerant exits the refrigerant tank 12. In still another embodiment, the refrigerant sensor 18 may be placed in or outside a hose that contains the refrigerant exiting the refrigerant tank 12. In a further embodiment, the refrigerant sensor 18 may also be placed anywhere among the components (hoses, fittings, valves, etc.) that are between the refrigerant tank 12 and the A/C system 36 (FIG. 3) being charged.

In another embodiment of the invention, a temperature sensor 21 may be placed on an outside surface of a housing 23 of the recharging system 10. In a further embodiment, the temperature sensor 21 may be placed within the housing 23. The placement of temperature sensor 21 can be anywhere on or in the housing 23 so long it can measure the surrounding ambient temperature.

In addition, as also illustrated in FIG. 1, a controller 20 (further discussed in FIG. 3) is included in the recharging system 10. The controller 20, according to certain embodiments of the present invention, is electronically connected to and configured to obtain a temperature reading from the temperature sensor 18, and temperature sensor 21. Also, the representative controller 20 illustrated in FIG. 1 is further configured to obtain a temperature reading from a temperature sensor 34 (discussed below) coupled to or within the A/C system 36 to which the recharging system 10 is connected. As will be discussed in more detail shortly, the temperature reading from within the A/C system 36 may be obtained from the temperature sensor 34 that is either located within, temporarily connected to or permanently connected to the A/C system 36. The temperature sensors 18, 21, and 34 may transmit the sensed temperature via a wired or wireless connection. The sensed temperature may be transmitted when requested by the controller 20 or sent all the time or on a predetermined basis, such as every 30 seconds, minute, 5 minutes, 15 minutes, 30 minutes, hour, etc.

The controller 20, according to certain embodiments of the present invention, is also configured to control the hose connections 14 via valves 14" (FIG. 3) and, thereby, to control how much refrigerant flows from the refrigerant container 12 to the A/C system 36. For example, the controller 20 may be configured to actuate a solenoid valve(s) 14" included within the hose connections 14, thereby either allowing or restricting flow of refrigerant through each of the hoses 14' illustrated in FIG. 2.

In addition the above functionalities, the controller 20, according to certain embodiments of the present invention, is also configured to determine a compensated amount of refrigerant to be added to the A/C system 36. As will be discussed in more detail below, such a determination may be made, for example, based upon the refrigerant temperature obtained from within the container 12 and A/C system 36 (or the ambient temperature).

Figure 3:
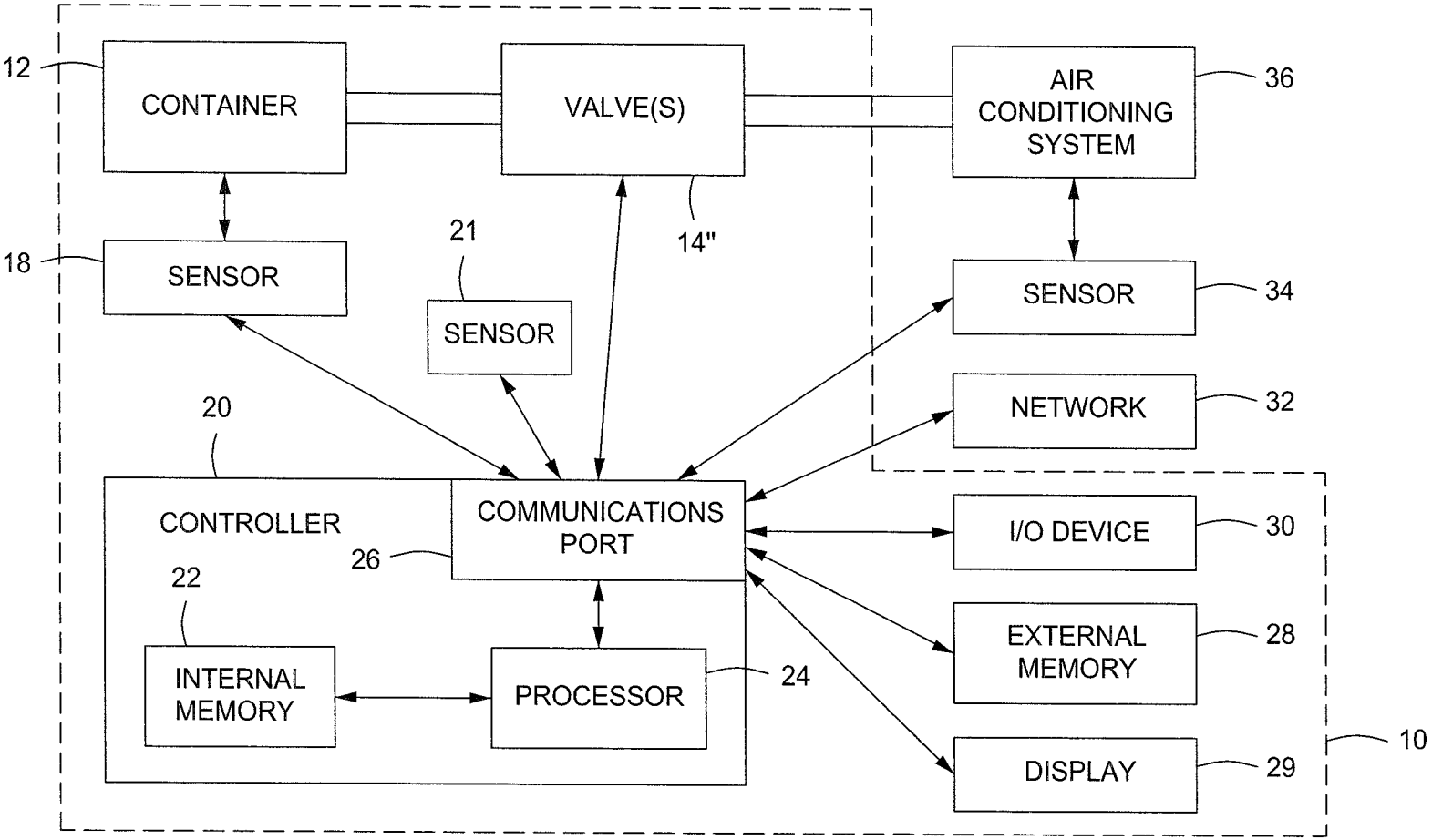
FIG. 3 is a schematic diagram of some components included within and/or that may be connected to the air conditioning recharging, system illustrated in FIGS. 1 and 2.

FIG. 3 is a schematic diagram of some components included within and/or that may be connected to the air conditioning recharging system 10 illustrated in FIGS. 1 and 2. FIG. 3 illustrates that the controller 20, according to certain embodiments of the present invention, includes art internal memory 22, a processor 24 and a communications port 26. The representative communications port 26 illustrated in FIG. 3 is also connected to an external memory 28, a display 29, an input/output (I/O) device 30, a network 32, the temperature sensor 18 that monitors the temperature in the refrigerant container 12, the temperature sensor 21 that monitors ambient temperature, and the temperature sensor 34 that is connected to and monitors temperature in the A/C system 36.

Also illustrated in FIG. 3 are valves 14" (e.g., a solenoid valve) that, according to certain embodiments of the present invention, are either included within or connected to the hose connections 14 illustrated in FIG. 2. When the recharging system 10 illustrated in FIG. 3 is in operation, the valve 14" may be opened and shut by the controller 20 based on the steps discussed below.

Either or both of the memories 22, 28 illustrated in FIG. 3 may be configured to store one or more formulas and one or more measured temperatures used to calculate the amount of compensated refrigerant that should be added to an A/C system based upon relative temperature measured at the refrigerant container 12 and the A/C system. Alternative, the network 32 can be used to provide the formulas discussed herein to the processor 24.

The temperature sensor 34 illustrated in FIG. 3 is, according to certain embodiments of the present invention, connected to both the controller 20 and the A/C system 36. Depending on the embodiment, the temperature sensor 34 may be either entirely or only partially contained within the A/C system 36. In one example, the temperature sensor 34 may be connected to a condenser of the A/C system 36. According to certain other embodiments of the present invention, the temperature sensor 34 is connected to the controller 20 and a computer or computing system that is at least partially controlling a portion of the A/C system 36. For example, when the vehicle 16 illustrated in FIG. 2 is an automobile, the temperature sensor 34 may be connected to or may be a part of the automobile's on-board diagnostic (OBD) system. In such instances, the communications port 26 of the controller 20 may receive information from the temperature sensor 34 via the OBD system using a data link connector (not shown) connected via the communications port 26.

Many manufacturers of A/C systems such as the above-discussed system 36 publish the recommended amount of refrigerant to be included in their A/C systems for optimal operation. As such, the communications port 26 may be configured to receive information about the recommended amount of refrigerant from an input device used by an operator of the recharging system 10 reading a manufacturer's publication. For example, the I/O device 30 illustrated in FIG. 1 in the form of a keypad may be used to type in the recommended amount of refrigerant to charge that A/C system or the keypad can be used to enter the vehicle make and model and a database stored in memory 22 may be used to determine the proper amount of refrigerant to charge. Alternatively, the vehicle can be selected from vehicles displayed on the display. The display may be a touch screen so that the selection can be made on the display or the user can use the key pad to control the selection. The information entered by the keypad or selected on the display may be stored in memory or directly used by a processor.

According to certain other embodiments of the present invention, the communications port 26 is configured to receive remotely collected information about the recommended refrigerant amount from an electronic source. According to some such embodiments, an A/C system manufacturer, for example, publishes information about optimal refrigerant amounts on a web site, computer-readable disc or other electronic media. Also, a recharging system manufacturer may publish empirical data in a similar format for a variety of A/C systems and/or refrigerants and/or environmental conditions. Then, information about one or more of the optimal amounts is, for example, downloaded to the internal memory 22 of the controller 20 from the network 32, which may be an intranet, the Internet or some other electronic network. As an alternative, information from a disc or other electronic network may be transferred directly to the controller 20 when the I/O device 30 takes the form of a CD or DVD reader/writer. Once a sufficient amount of information has been imported, the system 10 may be used to charge or recharge an A/C system.

Figure 5:
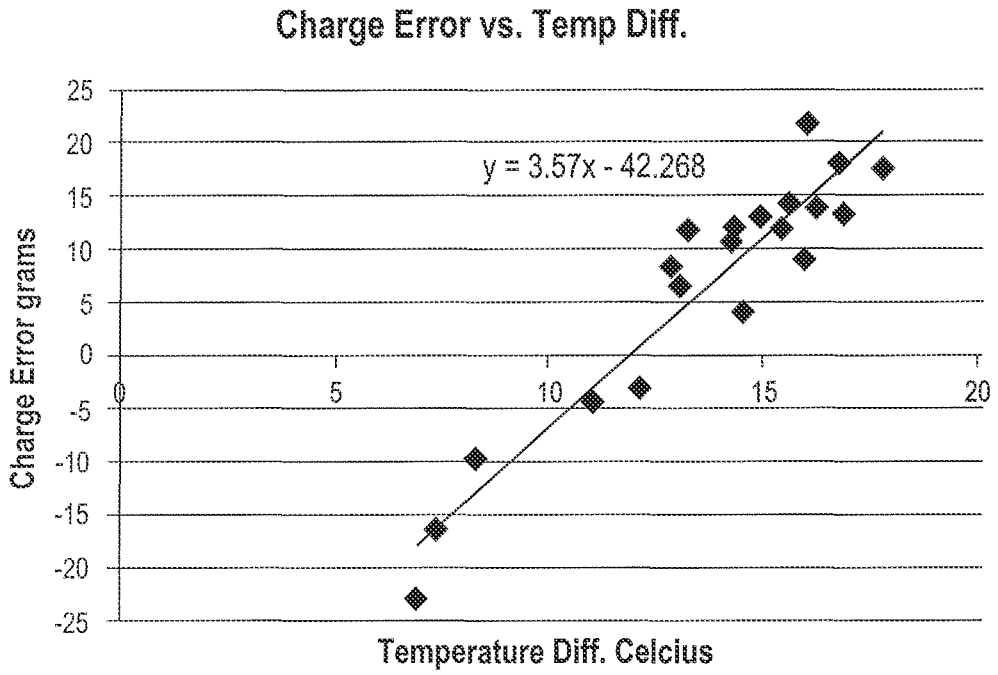
FIG. 5 is a graph showing a charge error versus a temperature differential.

FIG. 5 illustrates sample data points of charge error that may occur as the temperature differential increases between temperature of the refrigerant tank 12 and either the temperature A/C system or the ambient temperature. The data points are based on the formula $y=3.57x-42.268$, wherein y is the charge error and x is the temperature differential between the A/C system and the refrigerant tank and with a fixed 52 gram compensation amount. The fixed 52 grams is an exemplary amount of a typical compensation amount for certain A/C systems but it is should be noted that other fixed amounts may be used (more or less) and may be based on the A/C system being serviced. As shown in FIG. 5, as the temperature differential increases, the charge error in grams increases.

This equation is then used to calculate a new compensation amount for each data point, as discussed below. This new compensation amount was then added to the actual data points and re-plotted. The resultant graph is below in FIG. 6.

Figure 6:
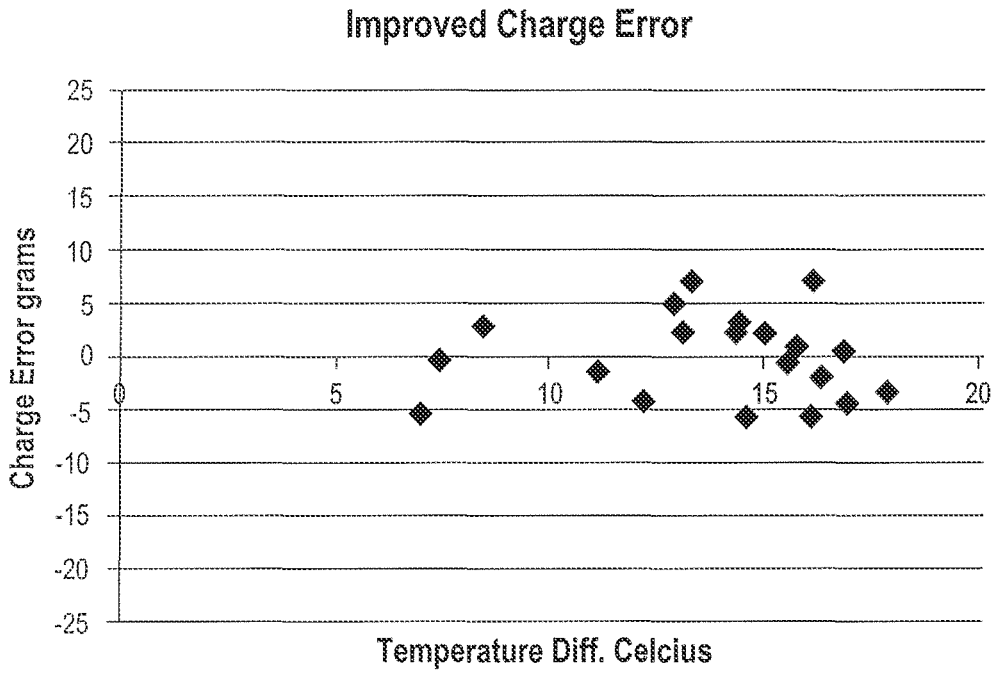
FIG. 6 is a graph showing a decreased temperature differential resulting in a decreased charge error.

As shown in FIG. 6, by decreasing the temperature differential, the charge error decreases. Thus, by knowing the temperature differential between the refrigerant tank 12 and the A/C system 36 will allow for a more accurate charge of the A/C system. This way, a proper compensated amount can be calculated and included during the recharge leading to a more accurate charge of the A/C system than conventional charging processes. The temperature differential between the refrigerant tank 12 and the A/C system 36 can be measured by the temperature sensor 18 at the refrigerant tank 12 and the temperature sensor 34 at the A/C system. Alternative to the temperature sensor 34, the temperature sensor 21 located in or on the recharging system 10 can be used so that the ambient temperature can be used. The ambient temperature can be used to estimate or simulate the temperature at the A/C system. This is because by the time the A/C system is charged, it would have sat around for a while (for the recovery and recycling of the refrigerant by the refrigerant system 10) and would have reached or be close to the ambient temperature.

Figure 4:
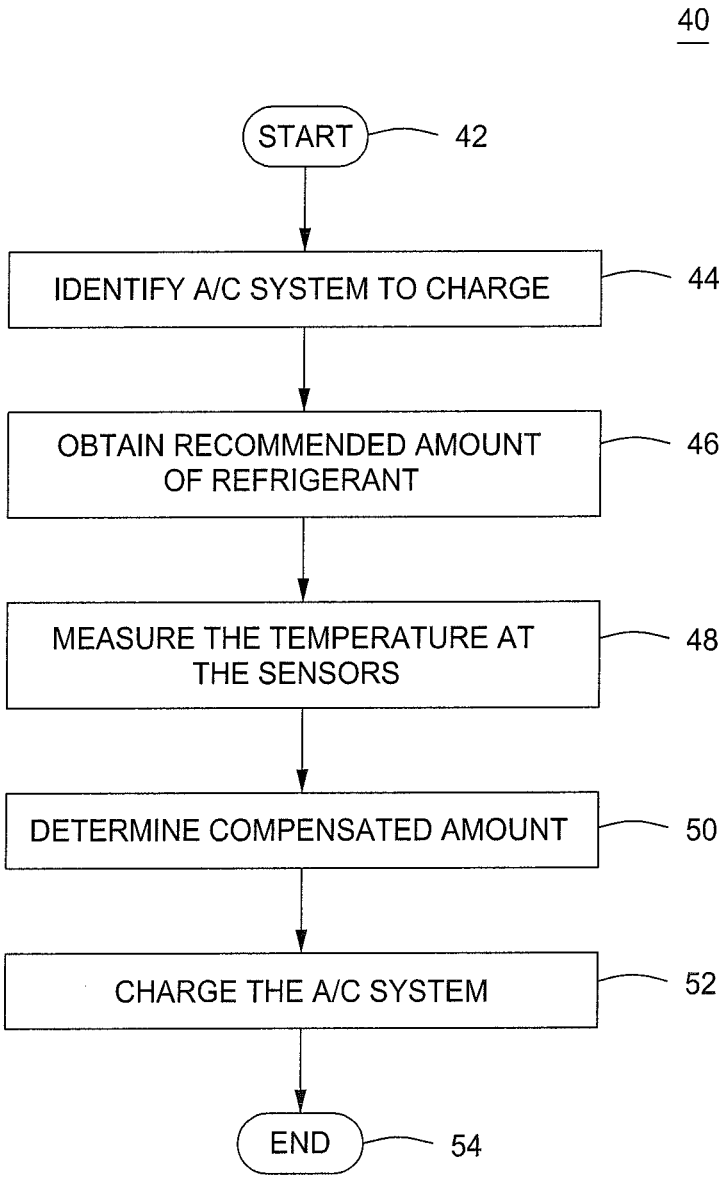
FIG. 4 is a flowchart illustrating steps of a method of charging an air conditioning system according an embodiment of the present invention.

FIG. 4 is a flowchart 40 illustrating the steps of a method of adding refrigerant to an air conditioning system according an embodiment of the present invention. As illustrated in FIG. 4, the method starts at step 42 and moves to step 44 to identify the A/C system 36 to charge. This A/C system can be located in a vehicle and the user can select the make and model of vehicle from a list presented on the display 29 of the refrigerant system 10. Alternatively, the user can enter the vehicle make and model (or VIN) using the key pad. Other types of A/C systems are also within the scope of the present invention, including those in residential or commercial buildings, planes, farm machinery, etc.

At step 46, obtain a recommended amount of refrigerant to charge the A/C system selected. According to certain embodiments of the present invention, step 46 includes obtaining the recommended amount of refrigerant (e.g., how much refrigerant is recommended to be added to the A/C system to achieve optimal performance) from at least one of the following sources: a manufacturer of the air conditioning system, a technical publication; an operation manual for the A/C system; an electronic source (e.g., a web site or a computer-readable media); and a marking on the air conditioning system (e.g., a sticker affixed to the system and providing manufacturing and/or operational details).

At step 48, measure the temperatures, which includes measuring a first temperature of the refrigerant container 12 using temperature sensor 18 and a second temperature within the A/C system using temperature sensor 34 (removable) or alternatively temperature sensor 21 located at the housing to measure the ambient temperature. Since the temperature sensor 34 may be part of a vehicle's larger system (e.g., an automobile's OBD system), according to certain embodiments of the present invention, step 48 may include obtaining the second temperature from a computer that is at least partially controlling a portion of the A/C system.

At step 50, determine a compensated amount of refrigerant to be added to the A/C system based upon the measured first refrigerant temperature and the second temperature. The compensated amount allows for compensation of refrigerant that may remain in the hoses or fittings during recharge, thus preventing a full charge of the recommended refrigerant. The compensated amount may be calculated by starting with the 52 gram amount and adding or subtracting the charge error (y) that was calculated using the formula $y=3.57x-42.2680$. As an example, if the temperature differential between the A/C tank and the vehicle is 10° C., the charge error is −6.565. Thus, the compensated amount is 52−6.565 g or 45.435 g. The compensated amount is added to the recommended amount of refrigerant (minus a percentage (e.g. 1%-3%) so as to not over charge the system) that will be charged to the vehicle.

At step 52, charge the A/C system by charging an amount that includes the compensated amount and the recommended amount of refrigerant from the refrigerant container 12 to the A/C system. Step 52 may be implemented, for example, by using the controller 20 to open the valve 14", thereby allowing refrigerant to flow from the container 12 to the A/C system 36. In order to determine how much refrigerant has been added to the A/C system, the refrigerant container 12 may be placed on a scale 11 as illustrated in FIG. 1 and weighed before and after refrigerant has been added to the A/C, system. Also, flow meters and/or of any other device or system that would become apparent to one of skill in the art to use upon practicing the present invention may be used to measure the amount of refrigerant that was added to the A/C system at step 52. It should be noted that when the scale 11 is used, charge accuracy is improved by pausing after each charge of refrigerant has been added as this allows for refrigerant in the refrigerant container 12 to settle and for a more accurate weight reading to be taken. At step 54, the flow chart ends.

By using the temperature differential between the A/C tank and the vehicle (or ambient temperature), a more accurate amount of refrigerant may be added to A/C systems under charge. Thus, amounts of refrigerant that may be trapped in hoses or fittings during a charge may be taken into account during charging so that the A/C system is not under charged, which can lead to decrease performance.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method of adding refrigerant to an air conditioning system connected to a refrigerant charging system, the method comprising:

obtaining a recommended amount of refrigerant for the air conditioning system;

measuring a first refrigerant temperature with a first temperature sensor, wherein the first temperature sensor is located on or near a refrigerant container of a refrigerant charging system;

measuring a second temperature with a second temperature sensor, wherein the second temperature sensor is located on or near the air conditioning system to be charged;

determining a compensated amount of refrigerant to be added to the air conditioning system via a set of hose connectors based upon a second temperature differential between the first refrigerant temperature and the second temperature, wherein the compensated amount of refrigerant allows for compensation of refrigerant remaining in the set of hose connectors; and charging the air conditioning system with the compensated amount of refrigerant and the recommended amount of refrigerant.

2. The method of claim 1 further comprising:

selecting a vehicle type in order to obtain the recommended amount of refrigerant for the air conditioning system.

3. The method of claim 1, wherein the recommended amount of refrigerant may be entered by a user.

4. The method of claim 1, wherein the determining the compensated amount of refrigerant step includes calculating an amount of charge error based on the first temperature differential.

5. The method of claim 1, wherein the determining the compensated amount of refrigerant step includes calculating an amount of charge error based on the first temperature differential and adding the calculated charge error amount to a predetermined amount of refrigerant.

6. A refrigerant charging apparatus, comprising: a refrigerant container configured to store a refrigerant; a set of hose connectors configured to facilitate transfer of the refrigerant from the refrigerant container to an air conditioning system; a first temperature sensor configured to determine a first temperature within the refrigerant container; a second temperature sensor configured to determine a second temperature, the second temperature being an ambient temperature near the refrigerant charging apparatus; and a controller configured to calculate a first temperature differential between the first and second temperatures, and using the first temperature differential to calculate a compensated amount of refrigerant to add to a recommended amount of refrigerant to charge the air conditioning system, wherein the compensated amount of refrigerant allows for compensation of refrigerant remaining in the set of hose connectors.

7. The apparatus of claim 6 further comprising:

a memory configured to store a formula used to calculate the compensated amount of refrigerant.

8. The apparatus of claim 7 further comprising a display that displays a list of vehicles and their respective air conditioning systems for a user to select in order to determine the recommended amount of refrigerant to charge.

9. The apparatus of claim 6 further comprising:

a third temperature sensor configured to measure a third temperature at the air conditioning system, the third temperature sensor is electronically connected to the controller.

10. The apparatus of claim 9, wherein the controller is further configured calculate a second temperature differential between the first and third temperatures, and using the second temperature differential to calculate the compensated amount of refrigerant to add to the recommended amount of refrigerant to charge the air conditioning system.

11. The apparatus of claim 6 further comprising:

a communications port electronically connected to the controller and to a computer that is at least partially controlling a portion of the air conditioning system.

12. The apparatus of claim 6 further comprising:

a communications port electronically connected to the controller and configured to receive information about the recommended amount of the refrigerant to be added to the air conditioning system.

13. The apparatus of claim 12, wherein the communications port is configured to receive the information about the recommended amount of refrigerant from an input device used by an operator of the apparatus.

14. The apparatus of claim 12, wherein the communications port is configured to receive the recommended amount of refrigerant from an electronic source.

* * * * *